US008058606B2

(12) United States Patent
Young et al.

(10) Patent No.: US 8,058,606 B2
(45) Date of Patent: Nov. 15, 2011

(54) MULTIPLEXED OPTICAL SENSOR SYSTEM AND METHOD

(75) Inventors: Paul D. Young, San Diego, CA (US); Michael Wong, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 430 days.

(21) Appl. No.: 12/255,715

(22) Filed: Oct. 22, 2008

(65) Prior Publication Data

US 2009/0189061 A1 Jul. 30, 2009

Related U.S. Application Data

(60) Provisional application No. 61/024,012, filed on Jan. 28, 2008.

(51) Int. Cl.
*B07C 5/00* (2006.01)

(52) U.S. Cl. ..... 250/223 R; 250/559.4; 209/576; 209/585; 271/9.03

(58) Field of Classification Search ..... 250/221, 250/223 R, 559.4; 209/576, 577, 585, 587; 271/9.02, 9.03, 259, 279, 290
See application file for complete search history.

(56) References Cited

U.S. PATENT DOCUMENTS

| | | | | |
|---|---|---|---|---|
| 4,265,440 | A | 5/1981 | Shibazaki et al. | |
| 4,520,263 | A | 5/1985 | Kitamura | |
| 5,266,812 | A | 11/1993 | Mokuo | |
| 5,821,551 | A | 10/1998 | Roh | |
| 6,009,804 | A * | 1/2000 | Yamada | 101/2 |
| 6,334,752 | B1 | 1/2002 | Suzuki | |

FOREIGN PATENT DOCUMENTS

| | | |
|---|---|---|
| JP | 58089558 | 5/1983 |
| JP | 58089559 | 5/1983 |

* cited by examiner

*Primary Examiner* — Kevin Pyo

(57) ABSTRACT

An inspection device includes a movable portion, and a substantially fixed portion. The movable portion includes a plurality of bins as well as beam directors positioned between the bins. The fixed portion includes light detectors and light emitters. The light detectors are arranged to allow multiplexing of the light detectors.

20 Claims, 9 Drawing Sheets

MULTIPLEXED OPTICAL SENSOR SYSTEM AND METHOD

CROSS REFERENCE TO RELATED APPLICATIONS

This Application claims the benefit of provisional patent application Ser. No. 61/024,012, filed Jan. 28, 2008 titled "MULTIPLEXED OPTICAL SENSOR SYSTEM AND METHOD" which application is incorporated by reference herein as if reproduced in full below.

TECHNICAL FIELD

Various embodiments described herein relate to an apparatus, system, and method associated with determining the presence of a media in a bin. More specifically, the apparatus, systems and methods relate to a multiplexed optical sensor.

BACKGROUND

In some commercial and retail settings, there is a need to sort multiple print jobs. For example, a retail photo printer will need to place different customer print jobs in different bins to keep them separated. In another example, a shared resource, such as a copying machine or work group printer, will need to place different print jobs in one of a number of different empty bins, trays or slots. In each instance it is necessary to determine whether a bin, tray or slot is empty before placing a set of prints or a print job into the bin, tray or slot. This assures that the prints or the print job in the slot is for one customer or user and will prevent someone from getting someone else's prints or print job. Furthermore, for order management, it is necessary to know which bins contain jobs, when the job is removed, and if any prints were left behind, as well as which bins are empty and available to receive a new print job. It is also necessary to determine when the bin is empty so that another print job can be placed in the bin. In addition, if the print job is finished, an operator or picker can be prompted to empty a bin. The same will happen if a bin is not totally empty.

In addition to print sorters, there may also be other sorters for copy jobs and the like. Sometimes mechanical sensors or electromechanical sensors are used to detect when a bins if a bin contains materials. Mechanical sensors or electromechanical sensors are less than totally reliable. If the mechanical sensor or electromechanical sensor is required to move with a bin, slot or tray, the mechanical or electromechanical sensor is more prone to failure and, therefore, less reliable. Contacts associated with wires may fail, wires may fail, and moving mechanical devices are prone to failure. If the mechanical sensor is powered by an electrical source, consistently powering a sensor that requires power while moving one or more of a set of bins also can be a challenge.

BRIEF DESCRIPTION OF THE DRAWINGS

The invention is pointed out with particularity in the appended claims. However, a more complete understanding of the present invention may be derived by referring to the detailed description when considered in connection with the figures, wherein like reference numbers refer to similar items throughout the figures and:

The description set out herein illustrates the various embodiments of the invention and such description is not intended to be construed as limiting in any manner.

DETAILED DESCRIPTION

Figure 1:
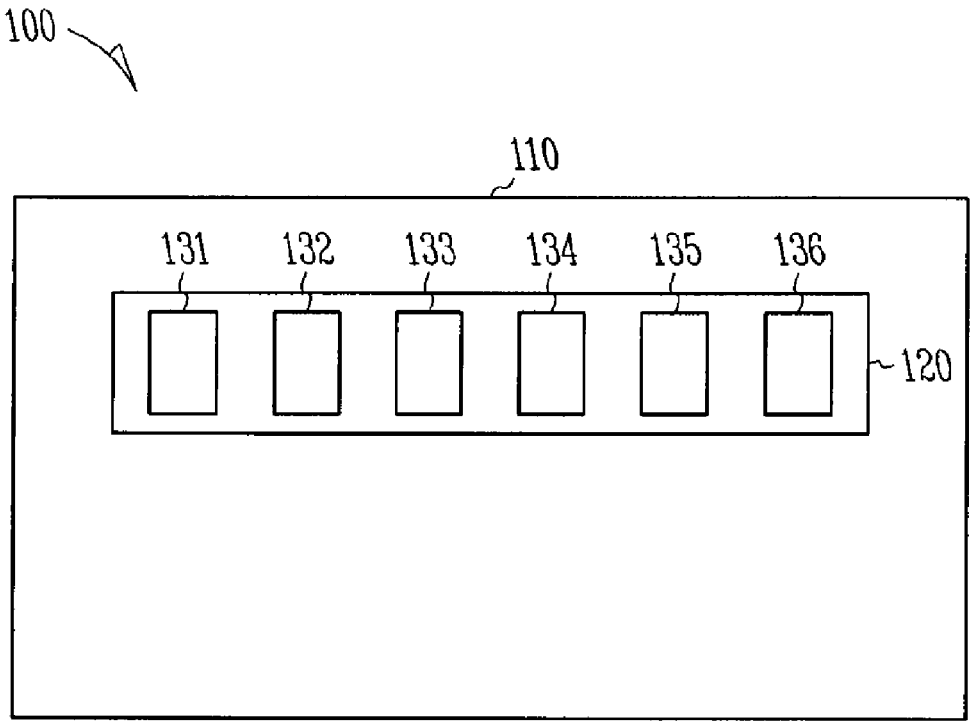
FIG. 1 is a schematic view of an apparatus that includes a sorting device, according to an example embodiment.

FIG. 1 is a perspective view of an apparatus 100 that includes a sorting device, according to an example embodiment. The apparatus 100 includes a fixed portion 110 and a movable portion 120. The movable portion 120 is attached to the fixed portion and can be positioned in a home position or datum position, or may be positionable to another position or many other positions. The movable portion 120 also includes a number of bins 131, 132, 133, 134, 135 and 136. In one example embodiment, the bins 131, 132, 133, 134, 135, 136 move with respect to the fixed portion 110 and provide the movement of the movable portion 120. In another embodiment, the movable portion itself 120 moves with respect to the fixed portion 110. In still another embodiment, the bins 131, 132, 133, 134, 135 and 136 move with respect to the movable portion 120 and the whole assembly then moves with respect to the fixed portion 110. In all instances, however, the movable portion 120 can be moved back to a datum position or home position where each of the movable portion 120 and the bins 131, 132, 133, 134, 135, 136 are in a known position with respect to the fixed portion 110.

Figure 2:
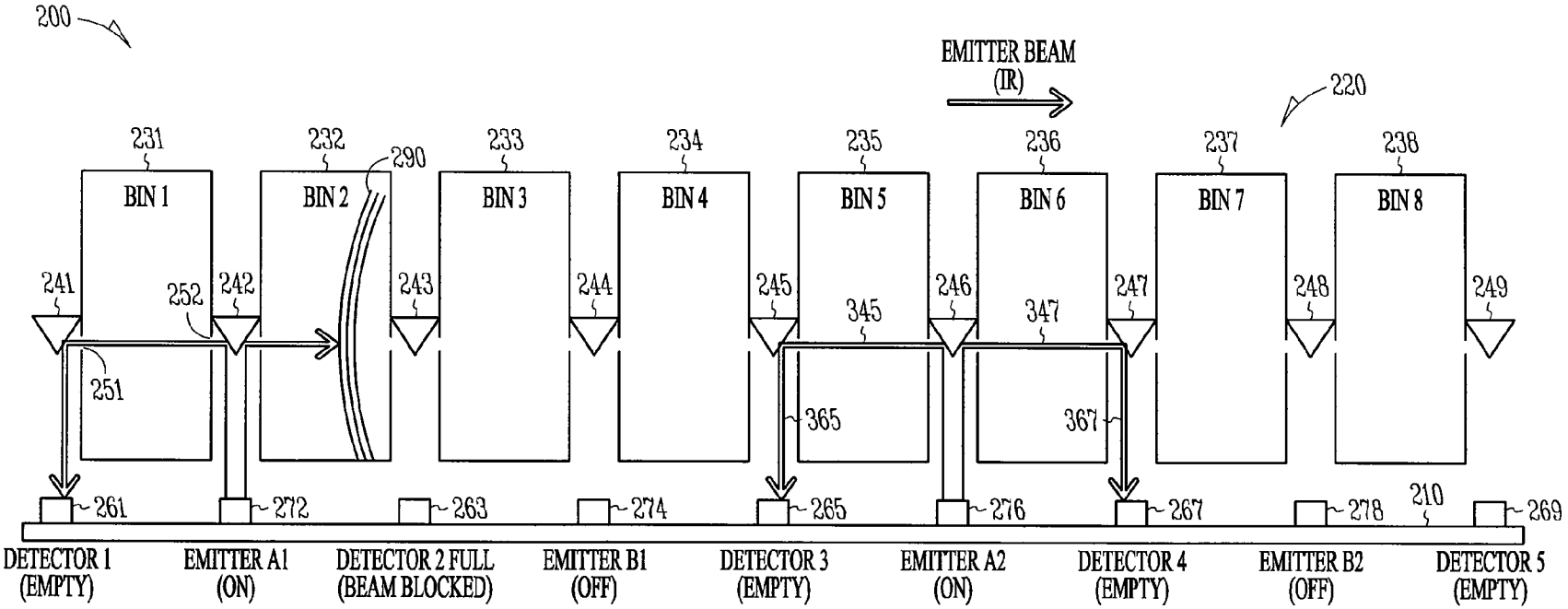
FIG. 2 is a schematic view of an apparatus that further details the sorting device, according to an example embodiment.

FIG. 2 is a schematic view of an apparatus 200 that further details the sorting device 220, according to an example embodiment. The apparatus 200 includes a fixed portion 210 and a movable portion 220 which could also be called the sorting device 220. The movable portion 220 includes a plurality of bins including bin 231, bin 232, bin 233, bin 234, bin 235, bin 236, bin 237, and bin 238. The bins 231, 232, 233, 234, 235, 236, 237, 238 are all capable of moving with respect to the fixed portion 210. The movable portion 220 also includes a plurality of beam redirectors 241, 242, 243, 244, 245, 246, 247, 248 and 249. In one embodiment, the beam redirectors 241, 242, 243, 244, 245, 246, 247, 248 and 249 are splitting reflectors. In other words, the splitting reflector is a beam having surfaces which are 90 degrees apart from one another and which can cause a single beam to split into two beams that travel substantially perpendicular to the original light beam. As shown in FIG. 2, beam redirectors 242, 243, 244, 245, 246, 247, and 248 are positioned between adjacent bins. Beam redirectors 241 and 249 are positioned on the outer edges of bin 231 and bin 238. Each of the bins, such as bin 231, also includes a set of apertures or openings 251 and 252. In other words, the bin 231 includes an aperture 251 and an aperture 252 therein. The apertures 251, 252 are aligned with one another so that a beam traveling perpendicular to an originating beam can pass through the bin 231. Each of the bins 231, 232, 233, 234, 235, 236, 237, and 238 has a similar set of apertures. Rather than describe each set of apertures, it will be understood that each of the remaining bins 232, 233, 234, 235, 236, 237, and 238 have a similar set of apertures.

The beam redirectors 241 and 242 are placed near the apertures 251 and 252 so that a redirected beam will travel through the bin and through the apertures 251 and 252. It will be understood that the beam redirectors 241, 242, 243, 244, 245, 246, 247, 248, and 249 are each placed near the respective apertures in an adjacent bin. The beam redirector 241, 242, 243, 244, 245, 246, 247, 248, and 249 are capable of either redirecting a beam so that it goes across a bin or receiving a beam that has traversed a bin and redirecting it. The beam redirectors 241, 242, 243, 244, 245, 246, 247, 248 and 249 may be optical reflectors or light pipes. Each of the beam redirectors, as shown in FIG. 2, redirects a light beam to position substantially 90 degrees away from the original light beam.

The fixed portion 210 includes a number of emitters or light emitters and a number of light detectors. As shown in FIG. 2, attached to the fixed portion are light emitter 272, light emitter 274, light emitter 276, and light emitter 278. The light emitters 272, 274, 276, 278 can emit either visible light or non-visible light, such as infrared light. Also attached to the fixed base portion 210 is a light detector 261, a light detector 263, a light detector 265, a light detector 267, and a light detector 269. The light emitters 272, 274, 276, 278 are positioned between light detectors 261, 263, 265, 267, and 269. In other words, light detectors and light emitters alternate as placed on the fixed base portion 210. A light emitter or a light detector is also placed in alignment with a light redirector. For example, light emitter 272 is in alignment with light redirector 242 when the movable portion 220 is in its home or datum position. When in its home or datum position, the detector 261 is aligned or substantially aligned with light redirector 241. Similarly, light detector 263 is aligned with or substantially aligned with light redirector 243, light detector 265 is substantially aligned with light redirector 245, light detector 267 is substantially aligned with light redirector 247 and light detector 269 is substantially aligned with light redirector 249. The light emitters 272, 274, 276, and 278 are also aligned with beam redirectors 242, 244, 246, and 248, respectively. Of course it should be emphasized that these alignments occur when the movable portion 220 is in a home or datum position with respect to the fixed portion 210. It should be noted to increase reliability of the apparatus 200, the light detectors 261, 263, 265, 267 and 269, as well as the light emitters 272, 274, 276, 278 are attached to the fixed portion 210. Therefore there is no need to make electrical connections to moving parts and this increases the reliability of the apparatus 200.

Each of the light emitters 272, 274, 276, 278 is capable of checking two bins at a time. Several of the light detectors, such as light detector 263, 265, and 267 are capable of receiving light from two emitters. These light detectors 263, 265 and 267 serve double duty in that a first time when light is received at one of these detectors 263, 265, 267, there is an indication that one of two bins is empty and while at another time when one of these detectors 263, 265, 267 receive light it is an indication that another of the bins is empty.

Figure 3:
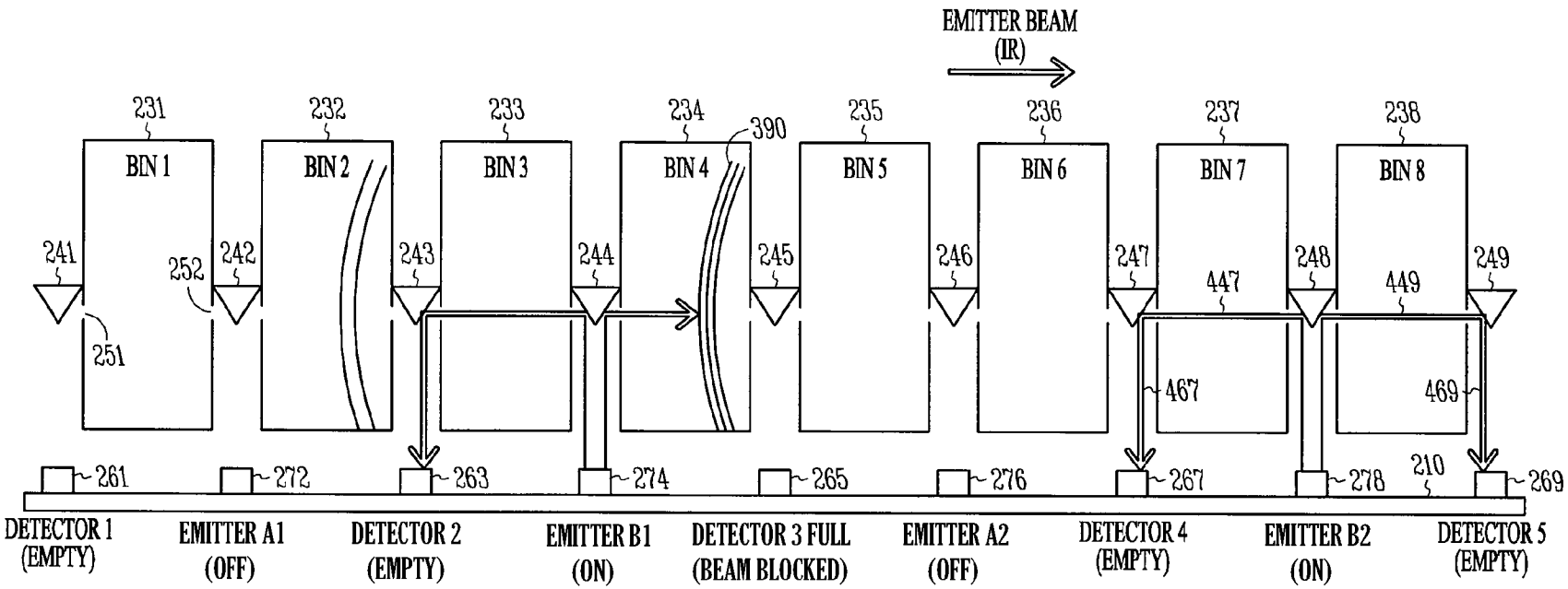
FIG. 3 is a schematic view of the apparatus of FIG. 2 at a second time, according to an example embodiment.

FIG. 3 is a schematic view of the apparatus 200 of FIG. 2 at a second time, according to an example embodiment. Therefore, the apparatus 200 is shown at a first time in FIG. 2 and at a second time in FIG. 3. All of the components in FIG. 3 are essentially the same. The difference between FIG. 2 and FIG. 3 is which of the emitters is enabled and which of the bins are being checked as empty or full as a result. Now referring to both FIGS. 2 and 3, the operation of the apparatus 200 will now be discussed. As mentioned above, the beam detectors 263, 265 and 267 serve double duty or are multiplexed to check different bins at different times. At time 1, the emitter 272 and the emitter 276 are enabled so as to produce a light beam. As shown in FIG. 2, emitter 276 produces a beam of light 376 which is directed toward the beam redirector 246. At the beam director 246, the light 376 is split into a first beam 345 and a second beam 347. The light beam 345 is directed to light redirector 245 while light beam 347 is directed toward the beam redirector 247. The beam redirector 245 redirects the beam 345 toward the detector 265. The redirected beam carries the reference number 365. At beam redirector 247 the beam 347 is redirected toward the light detector 267. The redirected light beam carries the reference numeral 367. If the beam 365 reaches the detector 265, an indication that the bin 235 is empty is stored in memory. If the beam 367 reaches the detector 267, there is an indication that bin 236 is empty and that is stored in memory. If the bin includes contents, such as bin 232 which includes contents 290, the beam is cutoff by the contents 290 within the bin 232. Therefore, the beam never makes it to beam director 243 and to the beam detector 263. Therefore, if the beam starting from the emitter 272 is not reached at the detector 263 there is an indication that the bin 232 is full or that the bin has contents. As shown in FIG. 2, the light from the emitter 272 is redirected by beam redirectors 242 and 241 and received at detector 261. As a result, the bin 231 is empty or devoid of contents. This indication is stored in memory.

FIG. 3 shows the device 200 at a second time. At this second time, the emitters 272 and 276 which were previously on are not enabled or turned off and the light emitters 274 and 278 are enabled. Thus, it can be seen between time T1 and time T2 every other emitter is enabled at the various times. As shown in FIG. 3, emitter 278 produces a beam 478 which is directed toward light redirector 248. At light redirector 248, the beam 478 is split into a first beam 447, which is directed toward beam redirector 247 and, and a second beam 449 which is directed toward beam redirector 249. Beam redirector 247 redirects beam 447 so that it is headed toward or at light detector 267. The redirected beam carries the reference numeral 467. When the beam 467 hits the light detector 247, an indication that bin 237 is empty is stored in memory. Similarly, beam redirector 249 redirects beam 449 toward the light detector 269. The redirected beam carries the reference numeral 469. When beam 469 hits light detector 269 an indication that beam 238 is empty is stored in memory. Thus, it can be seen in FIGS. 2 and 3 that at different times the light detector 267 receives different beams. As shown in FIG. 2, light detector 267 receives light beam 367 at time T1 to give an indication that bin 236 is empty and, as shown in FIG. 3, light detector 267 receives beam 467 at time T2 and this gives an indication that bin 237 is empty. Therefore, the light detector 267 is multiplex or serves double duty. It should also be noted that just like in FIG. 2, if a bin includes contents, such as bin 234 which includes contents 390, the beam from the light redirector is interrupted and a corresponding beam is not received at a detector, such as detector 265. When the emitter 274 produces a beam which is not split and detected at an adjacent detector, such as 265 at a time, such as time T2, an indication that a particular bin between the light emitter 274 and the detector 265 is occupied with media 390 is stored in memory.

Figure 4:
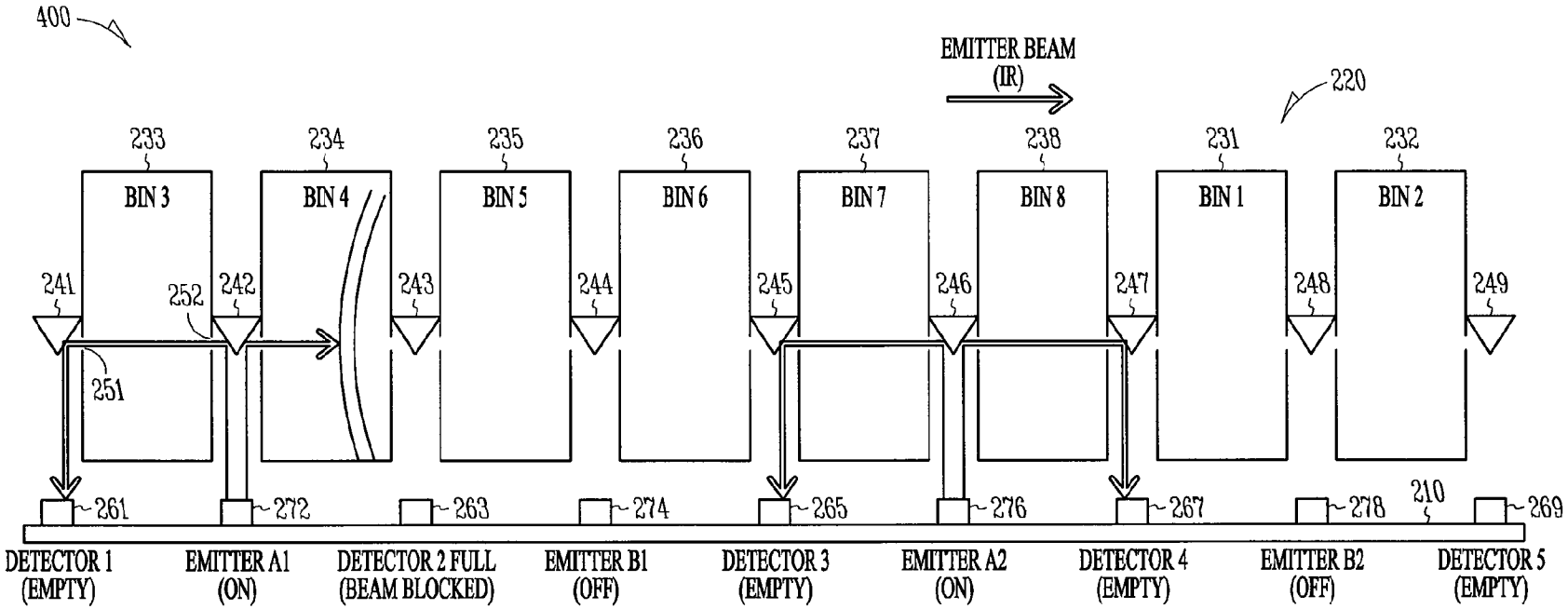
FIG. 4 is a schematic view of an apparatus that includes bins that are shifted, according to an example embodiment.

FIG. 4 is a schematic view of an apparatus 400 that includes bins which are shifted, according to an example embodiment. As shown in FIG. 4, the apparatus 400 includes a fixed portion 210 and a movable portion 220. In this particular embodiment, the bins can be shifted. For example as shown in FIG. 4, bins 231 and 232 are on the right-hand side of the diagram rather than on the left when compared with FIGS. 2 and 3. The apparatus 400 will operate in the same way, however, considering that the bins are shifted the indications that the light detectors at times T1 and T2 will be four different bins, otherwise the operation is substantially the same. FIG. 4 shows the emitters 272 and 276 being enabled in a similar fashion as they are at time T1 in FIG. 2. Emitter 272 and emitter 276 then will check bins 233 and 234 and bins 237 and 238 at time T1 while emitters 274 and 278 will check bins 235 and 236 and bins 231 and 232 at time T2. Thus, the operation is substantially the same and the bins are merely shifted so that the only difference is which bins are being detected as either full of contents or containing media and those which signals are empty for the various emitter and detector combinations. It should be noted that each of the bins 231, 232, 233, 234, 235, 236, 237, and 238 all have a home position where the beam redirectors 241, 242, 243, 244, 245, 246, 247, 248 and 249 are aligned with their respective detectors and emitters, 261, 272, 263, 274, 265, 276, 267, 278, and 269.

Figure 5:
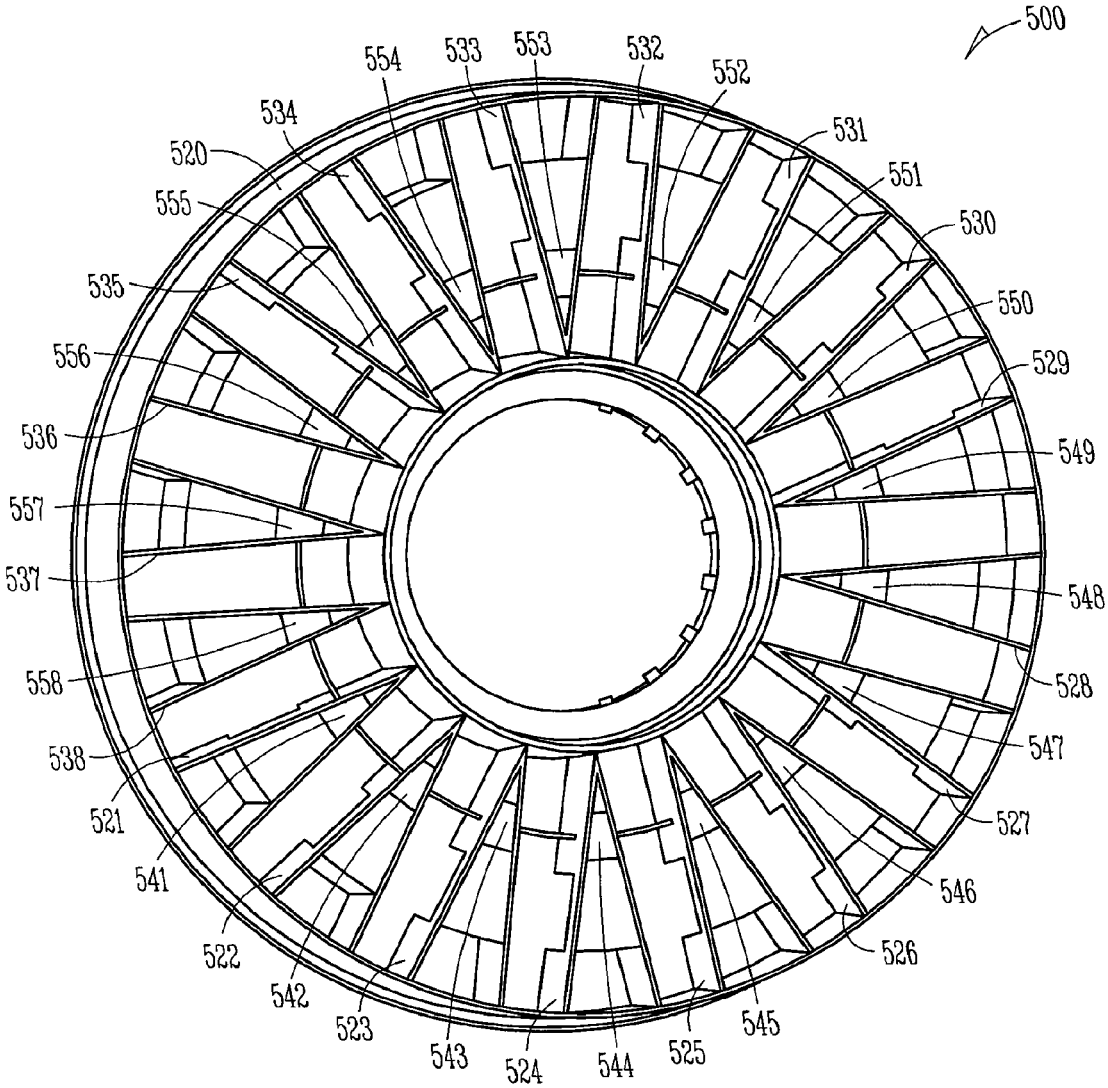
FIG. 5 is a perspective view of sorting device that includes a sorter wheel, according to an example embodiment.

FIG. 5 is a perspective view of a sorting device 500 that includes a sorter wheel 520, according to an example embodiment. The sorter wheel 520 is the movable portion of the device 500. The device or apparatus for sorting 500 also includes a fixed portion 510. The sorter wheel 520 includes a plurality of bins 521, 522, 523, 524, 525, 526, 527, 528, 529, 530, 531, 532, 533, 534, 535, 536, 537, and 538. Each one of these bins is capable of holding a media of some sort. Located between each of the bins is a beam redirector 541, 542, 543, 544, 545, 546, 547, 548, 549, 550, 551, 552, 553, 554, 555, 556, 557, and 558. The beam redirectors 541 to 558 are located between the bins and also are positioned to split an incoming beam and redirect the beam across one of the bins 521 to 538 where it meets another beam redirector and is directed toward a light detector on the fixed portion 510.

In this particular example embodiment, there are an equal number of bins and an equal number of beam redirectors 541 to 558. On the fixed portion 510 there will be half the number of bins which are light emitters. Thus, there will be approximately nine light emitters positioned about the periphery of the sorter wheel 520. The light emitters are positioned about the periphery so that the sorter wheel 520 may be stopped and when stopped a light emitter will be aligned with one of the beam redirectors 541 to 558 on the sorter wheel 520. Also attached to the fixed portion 510 of the device 500 are a number of light detectors which will also be aligned with the beam redirectors such that they can receive a beam of light which is redirected by one of the beam directors 541 to 558 on the sorter wheel. The number of light detectors will be exactly half the number of bins on the sorter wheel 520 and the number of emitters will be half the number of bins 521 to 538 on the sorter wheel. The detectors and emitters will be alternated in 18 positions around the sorter wheel on the fixed portion 510 of the device 500.

In operation, half of the emitters will emit light at a first time and another half of the emitters will emit light at a second time. In this particular embodiment, approximately 4 of the emitters will emit light at a first time and approximately 5 of the emitters will emit light at a second time. Each of the detectors will be multiplexed or capable of receiving two signals. Depending upon the time at which the particular time and which emitter emitted light at the particular time receiving light at a particular detector will determine whether one of two bins will be empty. In one example embodiment, the light detectors and emitters will be positioned on the outer periphery of the sorter wheel 520. In another example embodiment, the light emitters and detectors will be positioned on the inside of the sorter wheel. In either case, the light emitters and light detectors are positioned or attached to the fixed portion 510 of the apparatus 500 and therefore there is no need for providing electrical connections to mobile elements. As a result, the sorting device 500 is more reliable than when electrical connections have to be made to devices on a moving portion. The sorter wheel 520 can also be positioned in a fixed or datum position where all bins 521 to 538 and all beam redirection devices 541 to 558 are in a known position with respect to the various light detectors and emitters on the fixed base 510.

Figure 6:
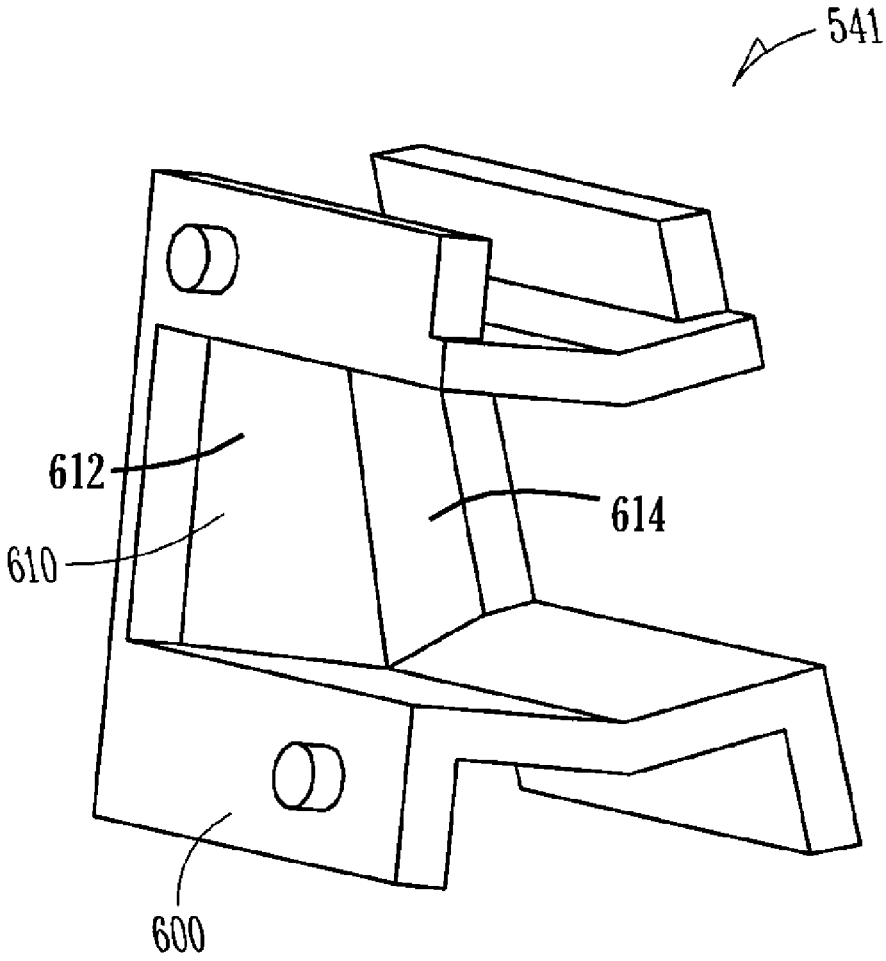
FIG. 6 is a perspective view of a beam redirector used on a sorter wheel in an example embodiment.

FIG. 6 is a perspective view of beam redirector, such as 541, used on a sorter wheel, such as sorter wheel 520, in an example embodiment. The beam redirector 541 includes a housing 600 and a mirror 610. The mirror has a first surface 612 and a second surface 614. The first surface 612 and the second surface 614 are angled with respect to each other. Light from a light emitter can be directed at the beam redirector or mirror 610 and will be split and redirected in two directions. The angle of the surface 612 will determine one direction and the angle of the surface 614 with respect to the incident light from the emitter will determine the direction of the second split beam. Each of the surfaces 612 and 614 is also capable of reflecting light that comes from across a particular bin. For example, the mirror 610 corresponds to the beam redirector 541 which is positioned between bin 521 and bin 522. Therefore, the light passing across bin 521 will reflect off surface 612 to a light detector and any light beam passing across bin 522 (see FIG. 5) will be reflected by surface 614 to the same light detector. Whether or not a beam is being reflected to a light detector or being reflected from a light emitter depends upon the position of the mirror 610 with respect to the bank of alternating light emitters and light detectors on the fixed portion 510 of the device 500 (see FIG. 5). The mirror 610 is held by a holder 600. The holder 600 can then be attached to the sorter wheel 520. Once the holder 600 and mirror 610 are attached to the sorter wheel, it generally remains fixed with respect to the sort wheel 520.

Figure 7:
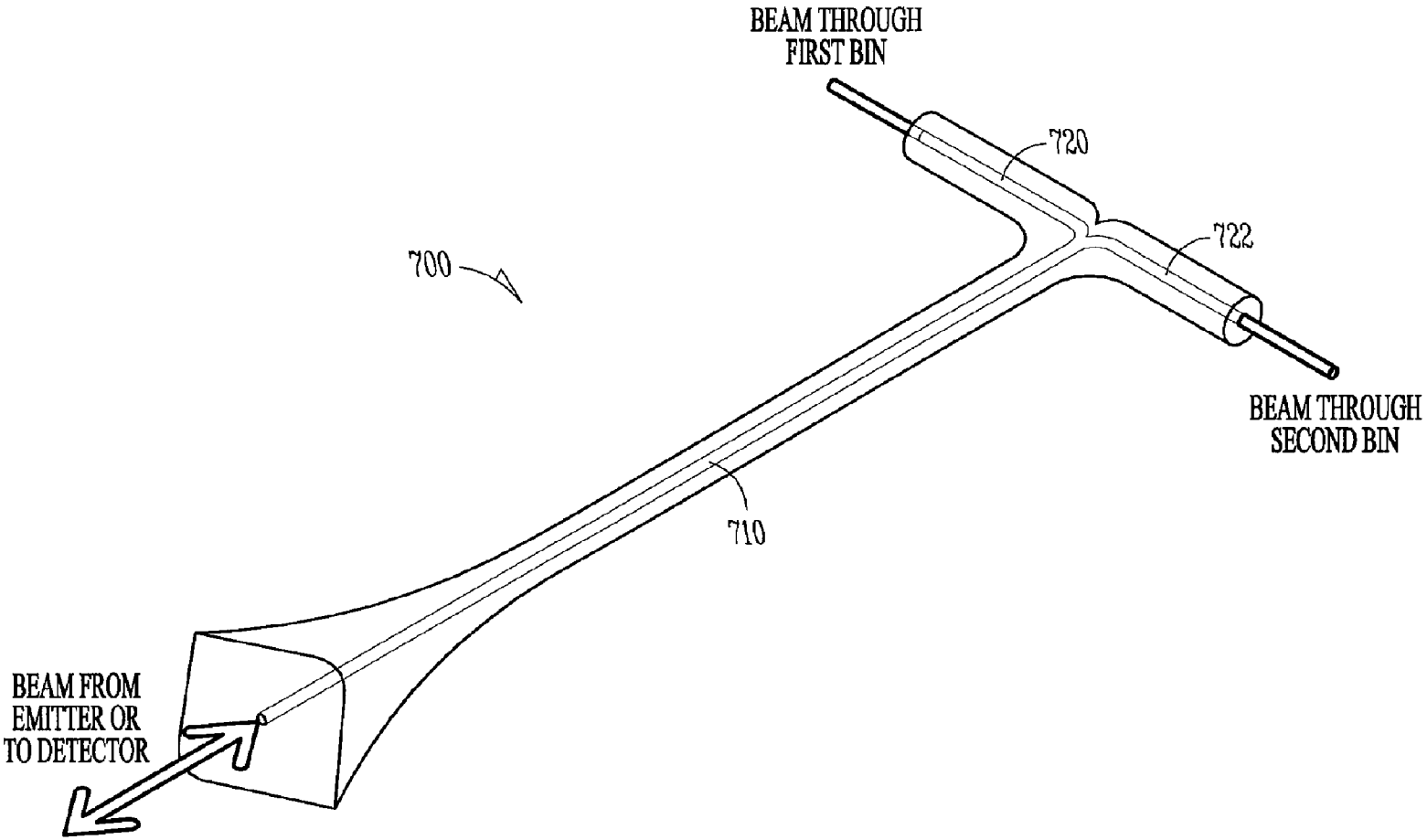
FIG. 7 is a perspective view of a light tube, according to an example embodiment.

FIG. 7 is a perspective view of a light tube 700. The light tube 700 can be used as a beam redirector, such as beam redirector 541. The light tube 700 includes a main body 710 and a first branch 720 and a second branch 722. Light beam either to or from an emitter or detector passes through the main branch 710. When the light beam is passing through the main housing or light tube 710 it is split at the branches between branch 720 and branch 722. Approximately half the beam of the light will travel down the first branch 720 and half the light beam will travel down branch 722. Each of the branches 720, 722 can receive light. The received light will then be transferred down the main body 710 of the light pipe 700 to a detector. Whether the light pipe 700 is transporting emitted light from a light emitter or whether it is transporting light to a light detector is dependant upon the position of the light pipe 700 with respect to the bank of alternating light detectors and light emitters on the stationary portion of a device, such as device 500 or device 200. Thus, the light pipe 700 can be used as a beam redirector in either of the devices 200 or 500.

An inspection device includes a movable portion, and a substantially fixed portion. The movable portion includes a first bin, having a first light path therethrough, and a second bin, having a second light path therethrough. The movable portion also includes a first beam redirector positioned beside the first bin and in the first light path, a second beam redirector positioned beside the second bin and in the second light path, and a third beam redirector positioned between the first and second bin and in the first light path and in the second light path. The substantially fixed portion includes a first light emitter positioned to send light to the first beam redirector, a second light emitter positioned to send light to the second beam redirector, and a first detector positioned between the first light emitter and the second light emitter and positioned to receive light from the third beam redirector. The third beam redirector is a beam splitter positioned to direct light from either of the first beam redirector or the second beam redirector to the detector. The inspection device also includes a control device for enabling light to be emitted from the first light emitter at a first time, and for receiving a signal at the first detector when the first bin is empty and for enabling light to be emitted from the second light emitter at a second time, and for receiving a signal at the first detector when the second bin is empty.

In one example embodiment, first beam redirector and the third beam redirector are positioned across the first bin, and the second beam redirector and the third beam redirector are positioned across the second bin. The movable portion is movable to a home position where the first light emitter and the second light emitter and the detector are aligned with the first beam redirector, the second beam redirector and the third beam redirector, respectively. In one example embodiment, the first beam redirector, the second beam redirector and the third beam redirector are beam splitters. The beam splitters may also include a mirror. In another embodiment, the beam splitters include a light pipe.

A bin inspecting device includes a housing and a movable portion. The movable portion includes a plurality of bins. The movable portion is attached to the housing and includes at least four of the plurality of bins adjacent each other and having a light path therethrough. The bin inspecting device includes a reflector that splits a light beam positioned between each of the at least four bins, a first light emitter attached to the housing, a second light emitter attached to the housing, and a light detector positioned attached to the fixed base and positioned to receive light reflected from the first splitting reflector and one of the second or third light detectors attached to the wheel.

A device includes a fixed base, and a wheel containing a plurality of adjacent bins. Each of the adjacent bins has a set of apertures therein aligned to allow a beam to pass through each bin. The device includes a plurality of splitting reflectors attached to the wheel. One of the plurality of reflectors is positioned between each of the plurality of bins. A light emitter, and a light detector are attached to the fixed base. The light detector is positioned to receive light reflected from two of the plurality of splitting reflectors attached to the wheel. In another embodiment, another light detector positioned to receive reflected light from one of the two of the plurality of splitting reflectors and another spitting reflector.

In another example embodiment, the movable portion also includes a third bin positioned adjacent the first bin, and a fourth bin positioned adjacent the second bin. The third bin includes a third light path therethrough. The first beam redirector is positioned between the first bin and the third bin. The fourth bin includes a fourth light path therethrough. The second beam redirector is positioned between the second bin and the fourth bin. A fourth light beam redirector is positioned beside the fourth bin and in the third light path. A fifth light beam redirector is positioned beside the fifth bin and in the fourth light path. The substantially fixed portion also includes a second light detector positioned to receive light from the fourth beam redirector, and a third light detector positioned to receive light from the fifth beam redirector. Light emitted from the first light emitter at a first time, is received at the first detector and the second detector when the first bin is empty and the third bin are empty. Light emitted from the second light emitter at the second time is received at the first detector and the third detector when the second bin is empty and the fourth bin is empty.

In some embodiments, the movable portion of the inspection apparatus is annular in shape, and the movable portion includes an equal number of bins and light beam redirectors. In addition, the number of light emitters is half the number of bins. Furthermore, the number of light detectors is half the number of bins.

Figure 8:
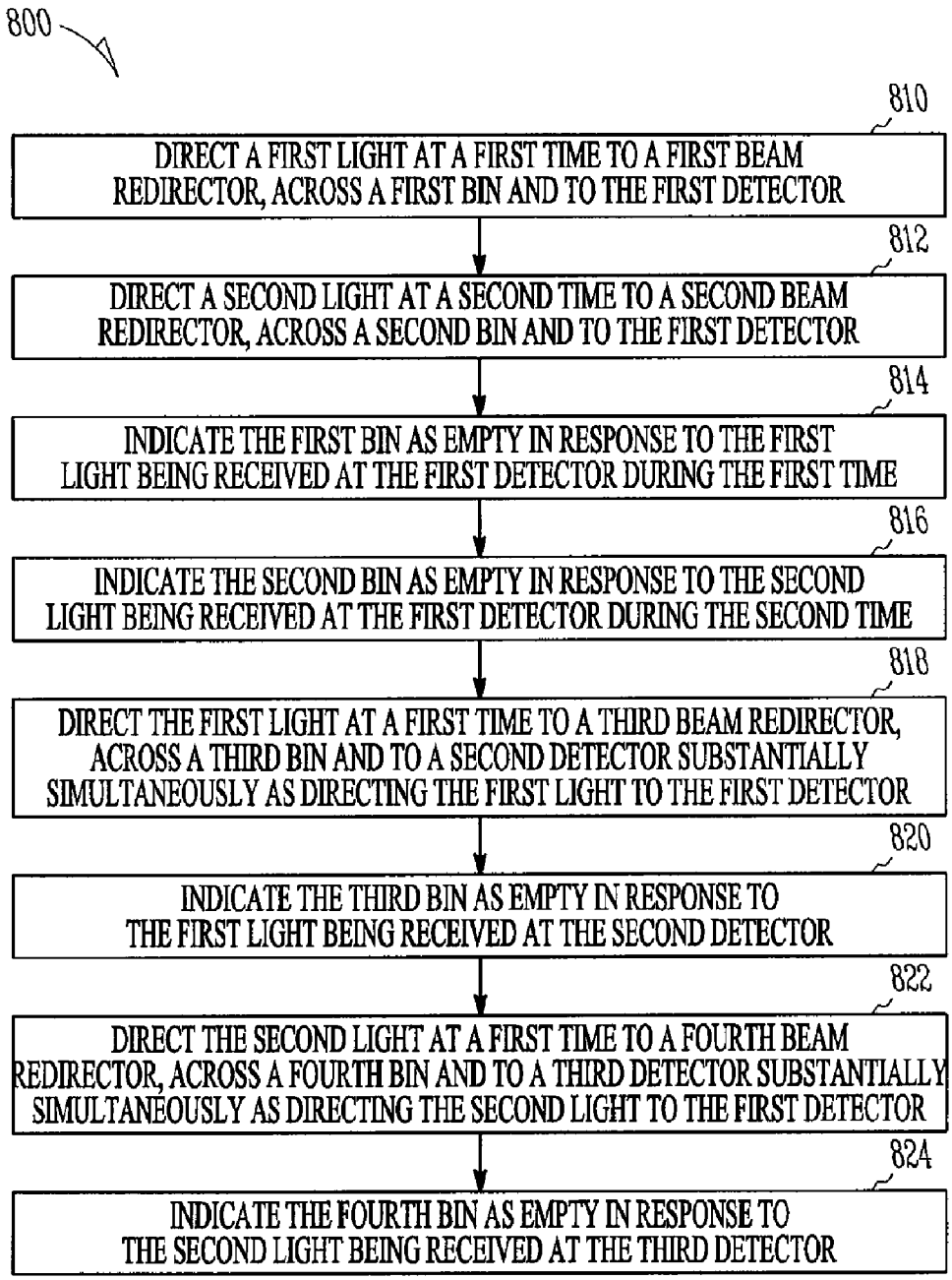
FIG. 8 is a flow chart of a method for inspecting the bins, according to an example embodiment.

FIG. 8 is a flow chart of a method 800 for inspecting the bins, according to an example embodiment. The method 800 of inspecting a plurality of bins includes directing a first light at a first time to a first beam redirector, across a first bin and to a first detector 810, and directing a second light at a second time to a second beam redirector, across a second bin and to the first detector 812. The method 800 also includes indicating the first bin as empty in response to the first light being received at the first detector during the first time 814, and indicating the second bin as empty in response to the second light being received at the first detector during the second time 816. The method 800 also includes directing the first light at a first time to a third beam redirector, across a third bin and to a second detector substantially simultaneously as directing the first light to the first detector 818. The method 800 also includes indicating the third bin as empty in response to the first light being received at the second detector 820. The method 800 may also include directing the second light at a first time to a fourth beam redirector, across a fourth bin and to a third detector substantially simultaneously as directing the second light to the first detector 822. The method 800 also includes indicating the fourth bin as empty in response to the second light being received at the third detector 824.

Figure 9:
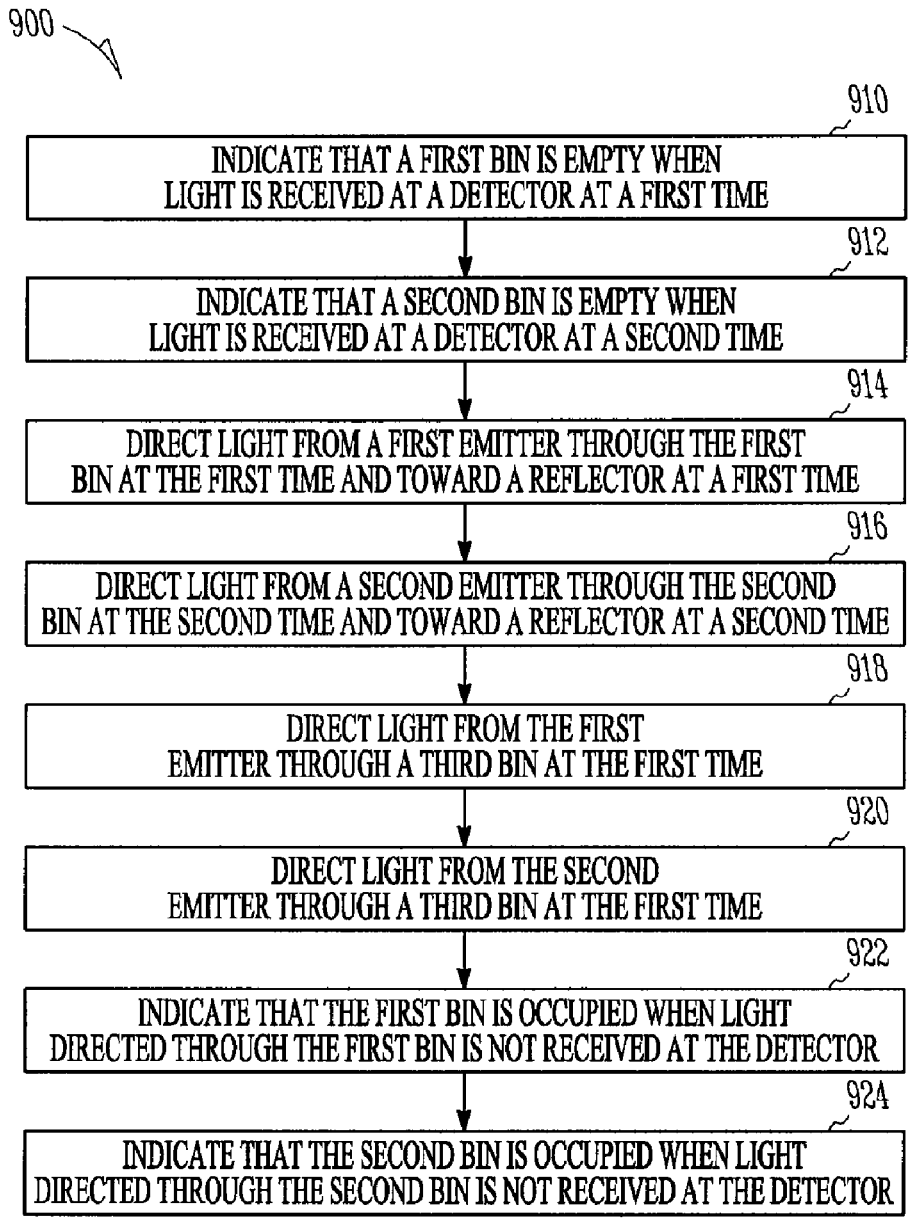
FIG. 9 is a flow chart of a method for inspecting bins, according to another example embodiment.

FIG. 9 is a flow chart of a method 900 for inspecting the bins, according to an example embodiment. The method 900 includes indicating that a first bin is empty when light is received at a detector at a first time 910, and indicating that a second bin is empty when light is received at the detector at a second time 912. The method 900 also includes directing light from a first emitter through the first bin at the first time and toward a reflector at a first time 914, and directing light from a second emitter through the second bin at the second time and toward the reflector at the second time 916. The method also 900 includes directing light from the first emitter through a third bin at the first time 918, and directing light from the second emitter through a third bin at the first time 920. The method 900 also includes indicating that the first bin is occupied when light directed through the first bin is not received at the detector 922. The method 900 also includes indicating that the second bin is occupied when light directed through the second bin is not received at the detector 924.

The foregoing description of the specific embodiments reveals the general nature of the invention sufficiently that others can, by applying current knowledge, readily modify and/or adapt it for various applications without departing from the generic concept, and therefore such adaptations and modifications are intended to be comprehended within the meaning and range of equivalents of the disclosed embodiments.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

What we claim:

1. An inspection device comprising:

a movable portion, the movable portion including:

a first bin, having a first light path therethrough;

a second bin, having a second light path therethrough;

a first beam redirector positioned beside the first bin and in the first light path;

a second beam redirector positioned beside the second bin and in the second light path;

a third beam redirector positioned between the first and second bin and in the first light path and in the second light path; and a substantially fixed portion, the substantially fixed portion including:

a first light emitter positioned to send light to the first beam redirector;

a second light emitter positioned to send light to the second beam redirector; and a first detector positioned between the first light emitter and the second light emitter and positioned to receive light from the third beam redirector, the third beam redirector being a beam splitter positioned to direct light from either of the first beam redirector or the second beam redirector to the detector.

2. The inspection device of claim 1 further comprising a control device for enabling light to be emitted from the first light emitter at a first time, and for receiving a signal at the first detector when the first bin is empty and for enabling light to be emitted from the second light emitter at a second time, and for receiving a signal at the first detector when the second bin is empty.

3. The inspection device of claim 1 wherein the first beam redirector and the third beam redirector are positioned across the first bin, and wherein the second beam redirector and the third beam redirector are positioned across the second bin.

4. The inspection device of claim 1 wherein the movable portion is movable to a home position where the first light emitter and the second light emitter and the detector are aligned with the first beam redirector, the second beam redirector and the third beam redirector, respectively.

5. The inspection device of claim 1 wherein the first beam redirector, the second beam redirector and the third beam redirector each include beam splitters.

6. The inspection device of claim 5 wherein the beam splitters include a mirror.

7. The inspection device of claim 5 wherein the beam splitters include a light pipe.

8. The inspection device of claim 5 wherein the movable portion further comprises:

a third bin positioned adjacent the first bin, the third bin including a third light path therethrough, the first beam redirector positioned between the first bin and the third bin;

a fourth bin positioned adjacent the second bin, the fourth bin including a fourth light path therethrough, the second beam redirector positioned between the second bin and the fourth bin;

a fourth light beam redirector positioned beside the third bin and in the third light path; and a fifth light beam redirector positioned beside the fourth bin and in the fourth light path;

and wherein the substantially fixed portion further comprises:

a second light detector positioned to receive light from the fourth beam redirector;

a third light detector positioned to receive light from the fifth beam redirector.

9. The inspection apparatus of claim 8 wherein light emitted from the first light emitter at a first time, is received at the first detector and the second detector when the first bin is empty and the third bin are empty, and wherein light emitted from the second light emitter at the second time is received at the first detector and the third detector when the second bin is empty and the fourth bin is empty.

10. The inspection apparatus of claim 1 wherein the movable portion is annular in shape and the movable portion includes an equal number of bins and light beam redirectors.

11. The inspection apparatus of claim 10 wherein the number of light emitters is half the number of bins.

12. The inspection apparatus of claim 10 wherein the number of light detectors is half the number of bins.

13. A method of inspecting a plurality of bins comprising:

directing a first light at a first time to a first beam redirector, across a first bin and to a first detector;

directing a second light at a second time to a second beam redirector, across a second bin and to the first detector;

indicating the first bin as empty in response to the first light being received at the first detector during the first time;

indicating the second bin as empty in response to the second light being received at the first detector during the second time and further comprising:

directing the first light at a first time to a third beam redirector, across a third bin and to a second detector substantially simultaneously as directing the first light to the first detector; and indicating the third bin as empty in response to the first light being received at the second detector.

14. The method of claim 13 further comprising:

directing the second light at a first time to a fourth beam redirector, across a fourth bin and to a third detector substantially simultaneously as directing the second light to the first detector; and indicating the fourth bin as empty in response to the second light being received at the third detector.

15. An inspection apparatus comprising:

means for directing light from a first source across a first bin and to a first detector;

means for directing light from a second source across a second bin and to the first detector;

means for directing light from the first source across a third bin and to a second detector; and means for controlling the light from the first source and the light from the second source so that light from the first source is produced at a first time and light from the second source is produced at a second time.

16. The inspection apparatus of claim 15 further comprising means for indicating that the first bin is empty when light is received at the first detector at the first time; and means for indicating that the second bin is empty when light is received at the first detector at the second time.

17. The inspection apparatus of claim 15 wherein the means for directing light from the first source comprises a first light emitter, a first beam redirector, and a second beam redirector, and the means for directing light from the second source comprises a second light emitter, a third beam redirector, and the second beam redirector.

18. The inspection apparatus of claim 15 further comprising means for directing light from the second source across a fourth bin to a third detector.

19. The inspection apparatus of claim 15 further comprising means for indicating that the first bin is occupied when light directed through the first bin is not received at the first detector.

20. The inspection apparatus of claim 15 wherein the first bin, the second bin, and the third bin are movable relative to the first detector and the second detector.

* * * * *

UNITED STATES PATENT AND TRADEMARK OFFICE

CERTIFICATE OF CORRECTION

PATENT NO. : 8,058,606 B2
APPLICATION NO. : 12/255715
DATED : November 15, 2011
INVENTOR(S) : Paul D. Young et al.

It is certified that error appears in the above-identified patent and that said Letters Patent is hereby corrected as shown below:

In column 10, line 25, in Claim 13, delete "time and" and insert -- time; and --, therefor.

Signed and Sealed this
Fourteenth Day of August, 2012

David J. Kappos

David J. Kappos
*Director of the United States Patent and Trademark Office*